US006519874B1

(12) United States Patent
Dean

(10) Patent No.: US 6,519,874 B1
(45) Date of Patent: Feb. 18, 2003

(54) SHOCK ABSORBENT FOOTWEAR ASSEMBLY

(75) Inventor: Norman Dean, Pleasant Valley, NY (US)

(73) Assignee: Footstar Corporation, West Nyack, NY (US)

( * ) Notice: Subject to any disclaimer, the term of this patent is extended or adjusted under 35 U.S.C. 154(b) by 0 days.

(21) Appl. No.: 09/943,095

(22) Filed: Aug. 30, 2001

(51) Int. Cl.[7] ..... A43B 13/00; A43B 13/08; A43B 13/37

(52) U.S. Cl. ..... 36/30 R; 36/35 R; 36/37; 36/43

(58) Field of Search ..... 36/28, 30 R, 33, 36/35 R, 37, 43, 44

(56) References Cited

U.S. PATENT DOCUMENTS 4,510,702 A 4/1985 Ehrlich, Jr.
4,918,838 A * 4/1990 Chang ..... 36/28
4,942,679 A * 7/1990 Brandon et al. ..... 36/44
5,086,574 A 2/1992 Bacchiocchi
5,311,677 A * 5/1994 Mann et al. ..... 36/35 R
5,649,374 A * 7/1997 Chou ..... 36/37
5,689,902 A 11/1997 Juang
5,775,005 A * 7/1998 McClelland ..... 36/28
6,050,001 A * 4/2000 Ditrtrich ..... 36/28
6,092,251 A * 7/2000 Tomat ..... 36/28
6,145,220 A * 11/2000 Johnson et al. ..... 36/30 R

FOREIGN PATENT DOCUMENTS

WO WO 90/15549 A1 * 12/1990

* cited by examiner

*Primary Examiner*—Anthony Stashick
(74) *Attorney, Agent, or Firm*—Ohlandt, Greeley, Ruggiero & Perle L.L.P.

(57) ABSTRACT

A footwear assembly having a footbed and an insole, which is removably secured to the footbed. The footbed includes a substantially flexible front portion and a rear portion connected to the front portion. The rear portion has a substantially rigid unit with at least one cavity. The cavity is adapted to receive a layer of cushioning material therein.

20 Claims, 2 Drawing Sheets

SHOCK ABSORBENT FOOTWEAR ASSEMBLY

BACKGROUND OF THE INVENTION

1. Field of the Invention

The present invention relates to shock absorbing footwear. In particular, the present invention relates to a footwear assembly having a footbed that has a substantially rigid unit with a cavity for receiving one or more layers of cushioning material.

2. Description of the Prior Art

U.S. Pat. No. 4,510,702 directed to a sole for shoes having a substantially rigid rear portion and a flexible front portion. The portions are connected approximately at the area of the ball of the foot.

U.S. Pat. No. 4,918,838 is directed to a sole with compressible shock absorbers. The shock absorbers are polygonal replaceable air bellows placed in a polygonal recess on the forefoot section of the shoe and a cylindrical replaceable air cylinder placed in a circular recess on the heel section of the shoe.

U.S. Pat. No. 5,086,574 is directed to an impact damping system for application to sport shoes having a hollow housing of flexible elastomeric material that is softer and more resilient than the insole material of the sport shoe. The hollow housing is removably placed in a cavity in the heel area of the shoe. In addition, one or more replaceable damping discs are inserted into the housing and are held therein by a cover that has downwardly extending pins to engage a groove in the disc and a peripheral flange at the lower end of the housing.

U.S. Pat. No. 5,689,902 is directed to a footwear that has an outsole with a recess in the heel portion for securing a cushion block thereto. The cushion block has a planar surface and an arcuate surface, opposite the planar surface, that has a plurality of integral rigid knobs. The cushion block is removably received in the recess of the outsole to allow the footwear to be used as an ordinary shoe, an exercise shoe, or a foot-massaging shoe.

U.S. Pat. No. 6,050,001 provides a shock absorbent shoe having an outsole with a toe, a heel and a cavity in the heel. An elastomeric shock absorbing plug is in the heel cavity. The plug has a planar lower surface and an upper surface that includes a raised central portion, an outer boundary, and an annular depression separating the raised central portion from the outer boundary. In addition, there is a resilient multi-density elastomeric insert.

U.S. Pat. No. 6,145,220 is directed to improved cushioning footwear in which the nail pattern is selected to avoid the presence of nails in the heel area opening. The shank is also designed so that it does not interfere with the insertion of the heel cushioning element in the heel area opening.

Although adequate shock absorption may be relatively easy to obtain, it, heretofore, required and/or provided a relatively heavy and uncomfortable structure.

The present invention overcomes the disadvantages of the current footwear by providing for comfortable, lightweight and shock absorbent footwear. The present invention also provides many additional advantages, which shall become apparent as described below.

SUMMARY OF THE INVENTION

It is an object of the present invention to provide a footwear assembly that is comfortable, lightweight and shock absorbent.

It is another object of the present invention to provide such a footwear assembly having a footbed with a substantially rigid unit that forms a cavity for receipt of a layer of cushioning material.

It is still another object of the present invention to provide such a footwear assembly where the substantially rigid unit is in a rear portion of the footbed.

It is yet another object of the present invention to provide such a footwear assembly having an insole, which is adapted to be removably secured to the footbed to provide easy access to the cavity.

It is still another object of the present invention to provide a shock absorbent footwear assembly that can be reliably and inexpensively manufactured.

The above and other objects and advantages of the present invention are achieved by a footwear assembly having a footbed with a substantially flexible front portion and a rear portion connected to the front portion. The footbed has a substantially rigid unit with a cavity embedded therein. The cavity is adapted to receive a layer of cushioning material. The footwear assembly preferably further comprises an insole, which is adapted to be removably secured to the footbed.

Other and further objects, advantages and features of the present invention will be understood by reference to the following specification in conjunction with the annexed drawings, wherein like parts have been given like numbers.

DESCRIPTION OF THE INVENTION

Figure 1:
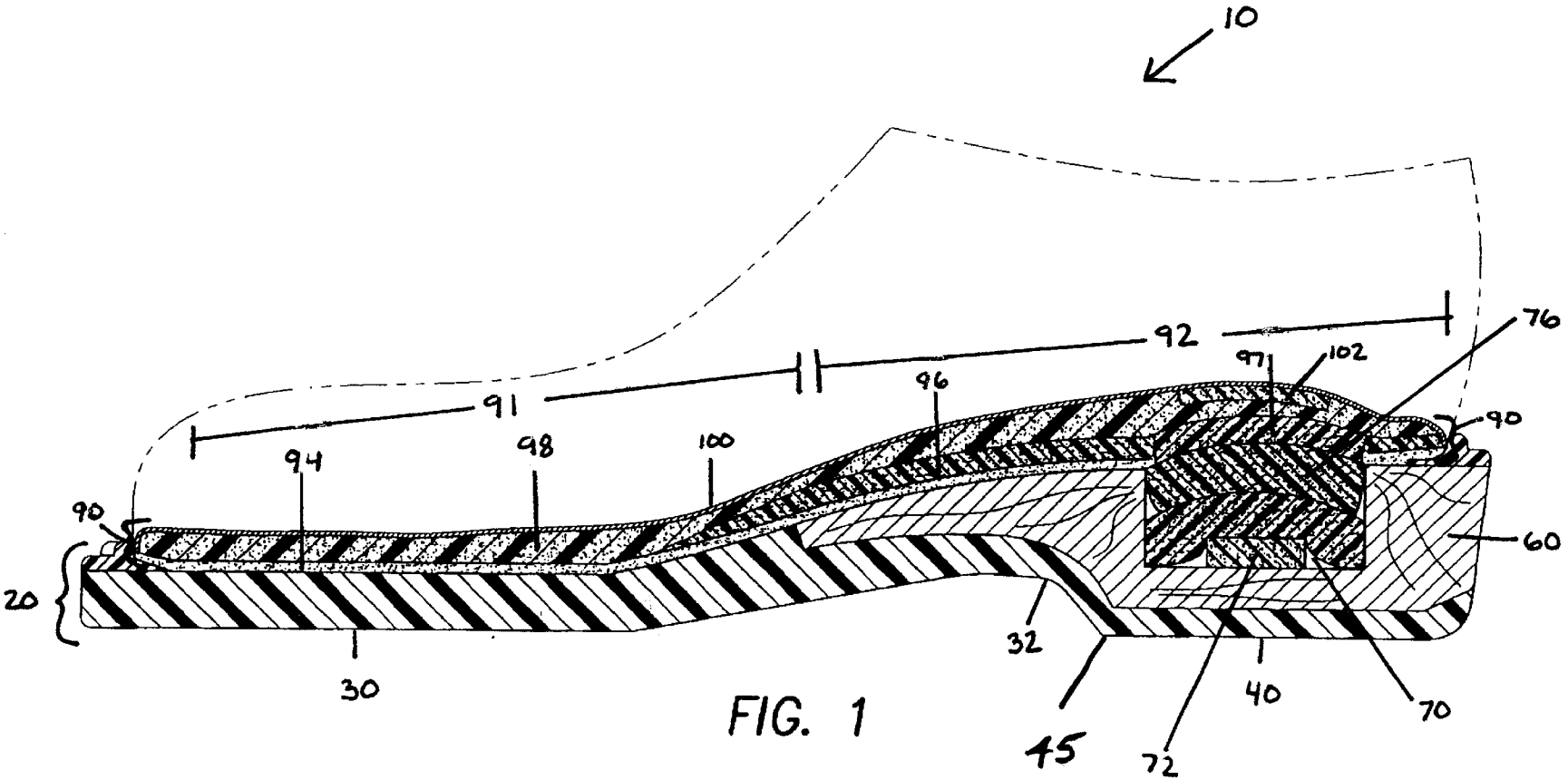
FIG. 1 is a sectional view of a preferred footwear assembly of the present invention.

Referring to the drawings and, in particular, to FIG. 1, there is shown a footwear assembly generally represented by reference numeral 10. Footwear assembly 10 has a footbed 20 with a front portion 30 and a rear portion 40 connected to the front portion. Rear portion 40 has a unit 60 with a cavity 70. Cavity 70 is adapted to receive at least one layer 76 of cushioning material therein. Footwear assembly 10 also preferably includes an insole 90, which is disposed over footbed 20.

Footbed 20 is made of a flexible material. Preferably, the material is rubber, and more preferably, coated rubber.

In one embodiment, front portion 30 forms an arch 32 in the arch area of the foot. Arch 32 terminates in a bottom surface 45 of rear portion 40. In the preferred embodiment, front portion 30 is adhesively connected to rear portion 40. Preferably, the adhesive material is glue.

Front portion 30 is made from a flexible material. In order to achieve the desired flexibility, front portion 30 is preferably made from a synthetic plastic material, for example, polyurethane.

Unit 60 of rear portion 40 extends into front portion 30 and terminates approximately in arch 32. Unit 60 can be made from a rigid or substantially rigid material. Preferably, unit 60 is made from wood, cork, plastic or any other suitable material or combination thereof as to provide a rigid and lightweight structure. In a preferred embodiment, unit 60 has a porous cellular structure. This can be achieved by arranging the material or materials forming unit 60 in layers. The porous cellular structure of unit 60 can also be achieved by forming unit 60 from a foamed hard polyurethane or a foamed polyvinyl chloride or polystyrene.

Figure 2:
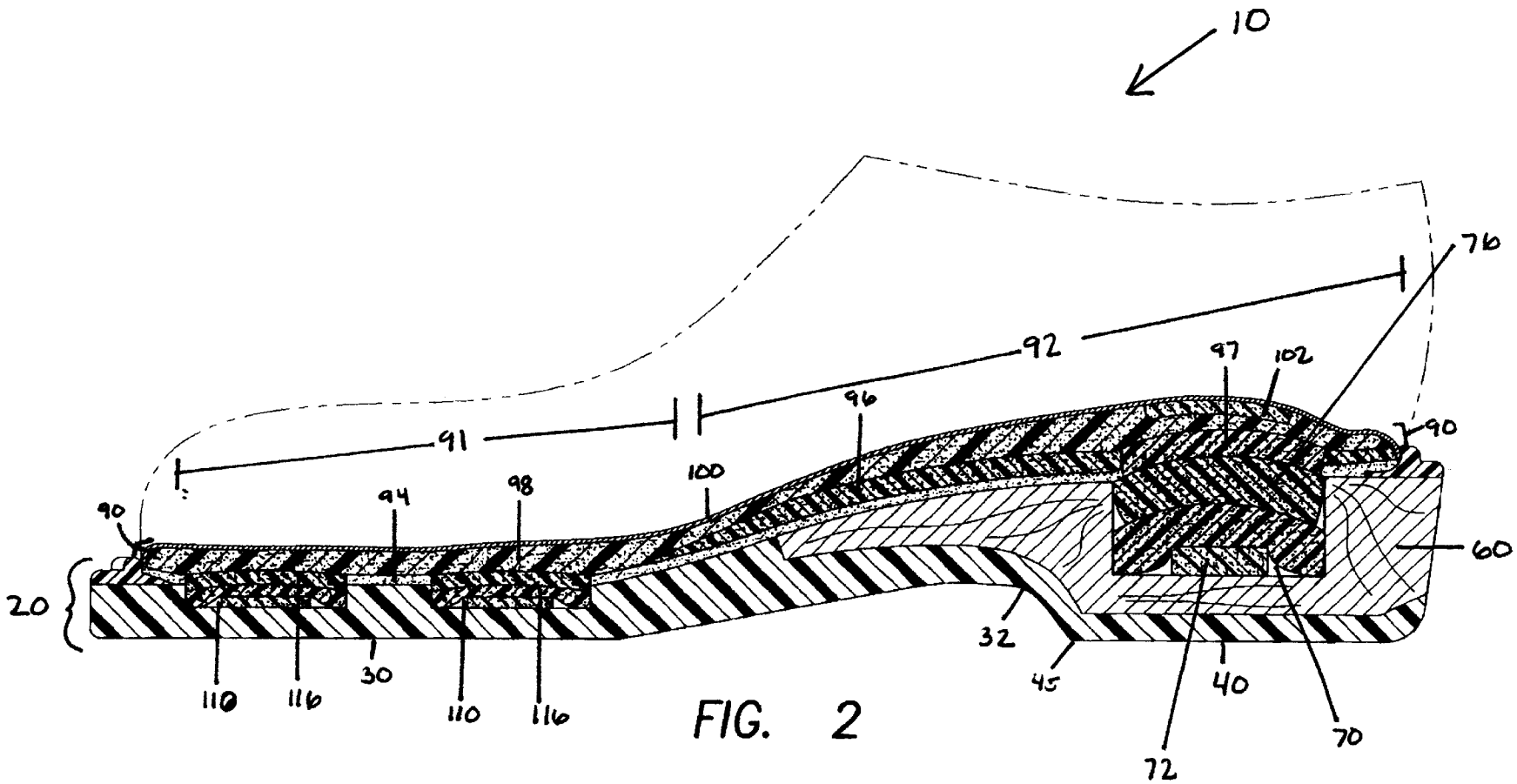
FIG. 2 is a sectional view of an alternative embodiment of the footwear assembly of the present invention.

As stated above, unit 60 also includes cavity 70 that is adapted to receive a layer 76 of cushioning material therein. The one layer 76 of cavity 70 preferably is, instead, two or more layers of cushioning material, as shown in FIGS. 1 and 2. The quantity, quality and pressure of cushioning material may be varied in order to obtain different degrees of cushioning and shock absorption. In a more preferred embodiment, the two or more layers 76 have a bottom layer 72. Bottom layer 72 is a cushioning layer made from a material similar to a material for front portion 30. Also preferably, bottom layer 72 is substantially shorter than the rest of the layers, thereby allowing for layers 76 to be curved about or outward, as shown in FIGS. 1 and 2. The advantage of this curve is that it eliminates or alleviates recession when pressure is applied and the area is compressed.

Preferably, the cushioning material is EVA (ethylene-vinyl acetate) or any other material exhibiting resiliency and shock absorbing qualities.

In a preferred embodiment, shoe assembly 10 also has insole 90. Insole 90 is preferably reasonably connected to footbed 20 by the conventional shoe assembly methods, for example, removable glue or adhesive. This feature allows for easy access to cavity 70. Insole 90 has a front region 91 and a heel region 92. Front region 91 is coincident with front portion 30 of footbed 20, while heel region 92 is coincident with rear portion 40 of footbed 20.

Insole 90 preferably includes layers of material to increase overall comfort and shock absorption of footwear assembly 10. Insole 90 has a layer 94, a middle cushion layer 96, a foam-type layer 98, and a said liner 100. Layer 94 is preferably positioned directly on footbed 20 and, preferably, extends throughout the length of footbed 20. More preferably, layer 94 has a cut-out or space that coincides or aligns with cavity 70. Layer 94 is a porous cellular structure. Preferably, the cellular structure is a cellulose fiberboard layer. More preferably, the fiberboard layer is elastomeric. Fiberboard layer 94 provides a surface to which an upper is attached.

In heel region 92, insole 90 has middle cushion layer 96 applied to layer 94. Layer 96 preferably has an insert 97 that coincides or aligns vertically with cavity 70 and, thus, layers 76. Thus, insert 97 acts in conjunction with layers 76 to provide a comfort and cushion effect in heel region 92. Cushion layer 96 is made of sponge rubber or latex. Insert 97 is made of a resilient material, such as PORON.

Insole 90 also has a foam-type layer 98. In front region 91, foam-type layer 98 is applied to fiberboard layer 94, while in heel region 92, the foam-type layer is applied to middle cushion layer 95. Foam-type layer 98 also provides comfort and cushioning to the wearer. Foam-type layer 98 is made of foam.

Sock liner 100 is positioned over foam-type layer 98 and, thus, front region 91 and heel region 92. In a preferred embodiment, sock liner 100 includes, in heel region 92, a microporous material 102. The material is preferably PORON.

In an alternative to this embodiment of the present invention, footwear assembly 10 may be used with a conventional dress shoe.

In the embodiment of the present invention depicted in FIG. 2, there is at least one cavity 110 located along footbed 20, and preferably in front portion 30. Similar to cavity 70, cavity 110 may have one or more layers 116 of cushioning material therein. This cushioning material may be the same as that in cavity 70, except it has less layers 76 and no layer 72. The quantity, quality and pressure of the material of layer 116 may also be varied to obtain different degrees of cushioning and shock absorption. A particular advantage of this embodiment is that the cushioning material in cavity 110 further increases shock absorbing qualities of footwear assembly 10. Thus, when a user strides forward, pressure is first applied to rear portion 40, where it is absorbed by cushioning material embedded in cavity 70, then, following a natural stride of a foot, the pressure is applied to front portion 30, where it is absorbed by cushioning material in cavity 110.

The present invention having been thus described with particular reference to the preferred forms thereof, it will be obvious that various changes and modifications may be made therein without departing from the spirit and scope of the present invention as defined in the appended claims.

What is claimed is:

1. A footwear assembly comprising:

a footbed having a substantially flexible front portion and a rear portion, said rear portion having a substantially rigid unit with at least one cavity, wherein said cavity is adapted to receive a layer of cushioning material therein;

an insole adapted to be removably secured to said footbed to provide an easy access to said cavity, said insole having a front region and a heel region, and a layer of cushioning material being secured to said insole, wherein said layer coincides or aligns vertically within said at least one cavity.

2. The footwear assembly of claim 1, wherein said substantially rigid unit has a porous cellular structure.

3. The footwear assembly of claim 1, wherein said substantially rigid unit is made of wood.

4. The footwear assembly of claim 1, wherein said flexible front portion is made of a synthetic plastic material.

5. The footwear assembly of claim 1, wherein said layer of said cushioning material is curved.

6. The footwear assembly of claim 1, wherein said layer of cushioning material is a plurality of layers of cushioning material.

7. The footwear assembly of claim 6, wherein said plurality of layers has at least one convex top layer and at least one bottom layer, said top layer being adapted to permit deformation in response to an application of a load, said bottom layer having a width that is less than a width of said at least one top layer, said bottom layer and said front portion being made from a material selected from the group consisting of a synthetic plastic, polyurethane, leather, a foam, ethylene-vinyl acetate, rubber, and a thermoplastic.

8. The footwear assembly of claim 1, wherein said layer of cushioning material is ethylene-vinyl acetate.

9. The footwear assembly of claim 1, wherein said insole has a cellulose fiberboard layer.

10. The footwear assembly of claim 9, wherein said insole also has a middle cushion layer positioned adjacent said cellulose fiberboard layer.

11. The footwear assembly of claim 10, wherein said insole also has a foam-type layer adjacent said middle cushion layer.

12. The footwear assembly of claim 1, wherein said insole also has a sock liner adjacent said foam-type layer.

13. The footwear assembly of claim 9, wherein said cellulose fiberboard layer has a cut-out that aligns with said at least one cavity.

14. The footwear assembly of claim 10, wherein said middle cushion layer has an insert that aligns with said at least one cavity.

15. The footwear assembly of claim 1, wherein said insole has a sock liner.

16. The footwear assembly of claim 15, wherein said sock liner includes a microporous plastic material.

17. The footwear assembly of claim 16, wherein said microporous material is PORON.

18. The footwear assembly of claim 1, wherein said footwear assembly is a shoe.

19. The footwear assembly of claim 1, wherein said front portion has a front cavity with cushioning material therein.

20. A footwear assembly comprising:

a footbed,having a substantially flexible front portion and a rear portion, said rear portion having a substantially rigid unit with one cavity, said rigid unit being wood, wherein said cavity is adapted to receive a layer of cushioning material therein;

an insole adapted to be removably secured to said footbed to provide an easy access to said cavity, said insole having a front region and a heel region;

a sockliner;

a plurality of layers of cushioning material, said plurality of layers being secured to said insole, said plurality of layers having a convex top layer and a bottom layer, said bottom layer having a width that is less than a width of each respective layer of said plurality of layers, said top layer being formed with at least one elastomeric cellulose fiberboard material disposed on top of said top layer of said plurality of layers, wherein said plurality of layers coincides or aligns vertically within said cavity.

* * * * *